US006634925B1

(12) United States Patent
Grivna

(10) Patent No.: US 6,634,925 B1
(45) **Date of Patent: *Oct. 21, 2003**

(54) WIDTH UTILIZATION PROMPTER/ MONITOR SYSTEM FOR WIDE-BELT ABRASIVE MACHINES

(76) Inventor: Howard W. Grivna, 12607 - 74th Ave. North, Maple Grove, MN (US) 55369

( * ) Notice: Subject to any disclaimer, the term of this patent is extended or adjusted under 35 U.S.C. 154(b) by 0 days.

This patent is subject to a terminal disclaimer.

(21) Appl. No.: 10/012,820

(22) Filed: Dec. 10, 2001

(51) Int. Cl.[7] ..... B24B 49/00

(52) U.S. Cl. ..... 451/5; 451/6; 451/8; 451/11; 451/299; 451/300

(58) Field of Search ..... 451/5, 6, 7, 299, 451/11, 300

(56) References Cited

U.S. PATENT DOCUMENTS 6,102,781 A * 8/2000 Greathouse et al. ..... 451/59

* cited by examiner

*Primary Examiner*—Joseph J. Hail, III
*Assistant Examiner*—Alvin J Grant
(74) *Attorney, Agent, or Firm*—Haugen Law Firm PLLP

(57) ABSTRACT

A prompter/monitor system for use in combination with wide-belt abrasive surface treating apparatus and including an array of individual axially spaced apart signal generating workpiece sensors operatively positioned across the width of the belt with each sensor creating a signal in response to the presence of a workpiece moving along a segment of the width of the belt. Readout means are provided for receiving signals from each of the sensors, with the readout means including a display responsive to a selected one of the workpiece sensors. A data processor is coupled to the readout for determining the accumulative duration of time during which a workpiece is detected by each sensor, and also determining that certain sensor which has detected the least duration of workpiece presence. The total amount of time for which workpieces are detected for each individual sensor are compared, and the display is actuated to represent those width segments which are being under (or over) utilized.

9 Claims, 3 Drawing Sheets

WIDTH UTILIZATION PROMPTER/ MONITOR SYSTEM FOR WIDE-BELT ABRASIVE MACHINES

BACKGROUND OF THE INVENTION

The present invention relates generally to a system for improving the equalization of overall utilization of wide abrasive belts utilized in surface abrading machines, and more particularly to a use prompter/monitor system for use in combination with such machines wherein an array of individual monitors and/or sensors is employed. Each sensor monitors one discrete segment of the transverse width of the belt, with the activity of each segment being compared to all others in the array. The system of the present invention serves to monitor the extent of usage across the entire width of the belt, and at the same time, serves to prompt the operator when certain segments are being overly utilized or alternatively are being under-utilized. Since the lifetime of a wide abrasive belt relates directly to the most heavily utilized segment, it serves an economic advantage as well as an environmental benefit to equalize belt usage as much as is practicable.

In the operation of many machines, and particularly wide-belt sanders, the recommended and preferred practice is to endeavor to have the workpieces or product being surfaced be substantially evenly fed across the working width of the machine. Because of variations in the application of these machines to a variety of different workpieces and due to individual operator preferences, it is generally acceptable if the product being surfaced is more or less evenly fed across the width of the machine.

As indicated above, the practice of feeding workpieces evenly is essential in order to distribute wear of machine components in addition to abrasive belts, such as conveyor belts, conveyor belt support beds, hold-down shoes, pinch rolls, contact drum surfaces and the like. It is also desirable to achieve uniform wear of other surface treating or surfacing components such as knife cutter heads, brushes, buffs, or other finishing or abrading-type tooling used on these machines. The term "abrasive belts" as employed herein is utilized in a comprehensive sense, and is intended to include those other moving surface treating components including knife cutter heads, brushes, buffs, or similar abrading-type tooling used on these machines.

It has been a long term and widely recognized problem throughout the industry that the seemingly simple task of evenly feeding workpieces or products across the width of a machine is difficult to achieve, and in certain instances, even more difficult to manage. Because of the nature of the individual operations or tasks, machine operators generally prefer to feed products in-line and management personnel and/or supervisors have no practical way to monitor this function so as to ascertain that even or uniform feeding of workpieces is being achieved. The width utilization system of the present invention will not only prompt an operator to evenly feed workpieces across the width of a machine, but will additionally provide supervisory personnel with the means to monitor individual operator performance as it relates to workpiece feed practices.

SUMMARY OF THE INVENTION

Briefly, and in accordance with the present invention, a wide belt utilization prompter/monitor system is provided for use in combination with wide-belt abrasive surface treating apparatus or systems. Wide-belt abrasive surface treating apparatus typically are provided with a frame which supports a conveyor with drive means for moving an endless belt in a drive direction along a defined path, with the belt accordingly having a top flight for transporting individual workpieces along a drive axis between an infeed and a discharge end. One or more workpiece treating stations are operationally positioned between the ends, with the workpiece treating station defining a wide abrading station. Typically, a wide abrasive belt or similar surface treating mechanism is disposed in one or more workpiece treating station with other devices such as, for example, rotary knife cutter heads, brushes, buffs, or other surface finishers being provided as required. Each workpiece treating station is superimposed adjacent the top flight and positioned to contact the surface of workpieces being transported along the conveyor top flight.

The abrasive use monitor system of the present invention comprises an array consisting of a plurality of axially spaced apart signal generating workpiece sensors, with these sensors being disposed in axially spaced apart relationship across the width of the belt, preferably transversely to the drive axis. Each sensor creates a signal in response to the presence of a workpiece moving along a certain discrete or predetermined transverse segment of the conveyor belt. A readout means such as a data processor system is provided for receiving signals from each sensor in the array, with the readout means including a readout indicator or information display. The data processor operatively responds to the signals generated by the sensors and the resultant information is displayed on an information display panel. The data processing means are coupled between the sensors and the readout means or information panel, and evaluates and determines the accumulative duration of time during which the presence of a workpiece is detected by each of the individual sensors comprising the array. By accumulating this information, the data processing means determines which individual sensor in the array has detected the shortest or lowest cumulative amount of time. Thus, the data processing means is adapted to compare the duration of cumulative times for which workpieces were detected by each of the individual sensors in the array relative to that certain sensor detecting the shortest duration of cumulative time. As an alternative, the data processing means may be adapted to detect which sensor in the array has the greatest duration of cumulative time of workpiece exposure. These extremes of cumulative exposure may be referred to as the "the range limit", and hence the term "range limit" is used in a comprehensive sense, and is intended to define one or the other of the extremes, either the greatest duration or the least duration. Additionally, the readout means are designed to indicate the differences in cumulative times for each sensor in the array relative to that certain sensor representing the extreme range limit of time, such as the shortest duration of cumulative time.

As an added feature of the present invention, the data processing means may include an input representing the conveyor rate of speed for determining the aggregate length of the individual workpieces which have been transported along the top flight and detected by the sensors over any desired period or interval of time. This feature advantageously provides information useful in determining when an individual abrasive belt or surface contacting member such as a knife cutter head is reasonably in need of replacement.

Therefore, it is a primary object of the present invention to provide an improved system for monitoring the operation of a workpiece surfacing component such as a wide abrasive belt so as to enhance uniform distribution of wear across the transverse width of the surfacing component.

It is yet a further object of the present invention to enhance the uniform utilization of a wide surface treating system such as an abrasive belt system wherein an array of individual axially spaced apart sensors are utilized to sense workpiece presence and thereby indicate the extent to which certain width segments of the apparatus have been exposed to contact with workpieces and to assist in uniform distribution of wear.

It is a yet a further object of the present invention to provide an improved monitor system for use with wide-belt abrasive surface treating apparatus wherein an array of individual axially spaced apart workpiece sensors are provided to gather data relating to the history of distribution of workpieces across the width of a conveyor-fed wide abrasive surface treating apparatus.

Other and further objects of the present invention will become apparent to those skilled in the art upon a study of the following specification, appended claims, and accompanying drawings.

IN THE DRAWINGS

Figure 4:
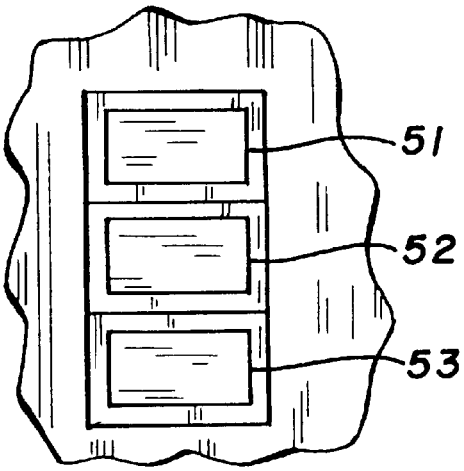
FIG. 4 is a fragmentary view illustrating one group of lighted indicia employed in the visual readout means or display panel of the present invention as shown in FIG. 3, with FIG. 4 being shown on a slightly enlarged scale.
Figure 5:
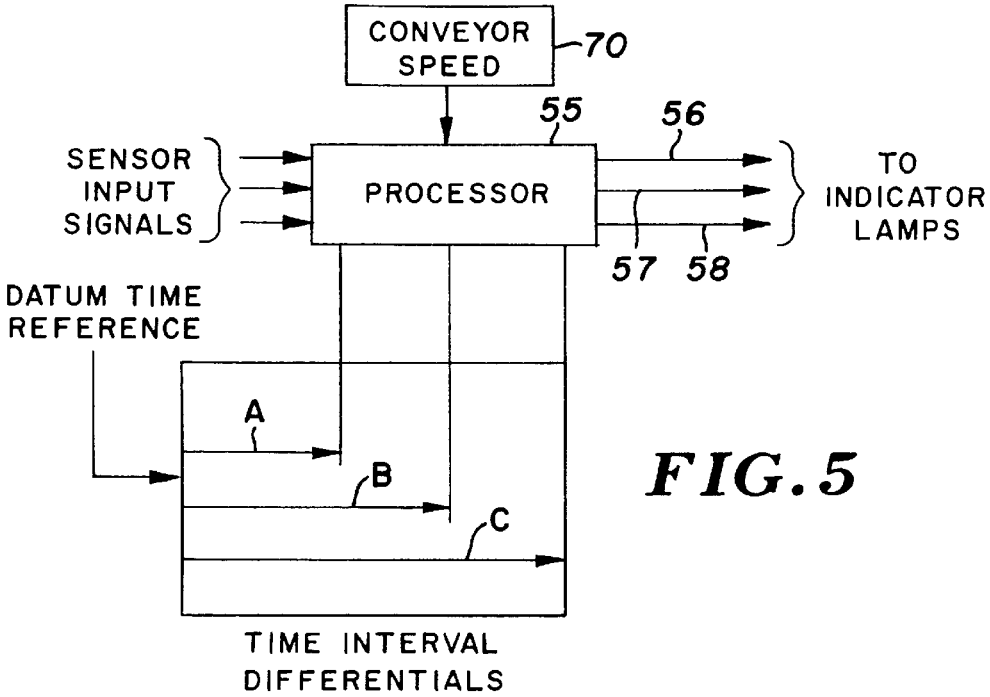
Figure 6:
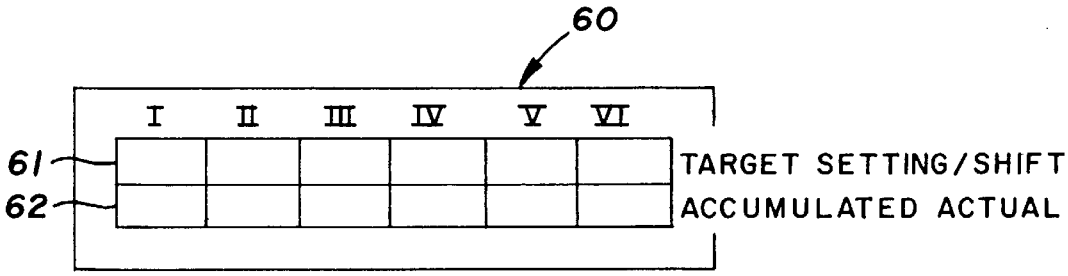

FIG. 5 is a flow chart illustrating the manner in which the sensors create data for forming a datum reference for the duration of time workpieces are detected, and illustrating the manner in which time interval differentials are determined, processed, and displayed, and further illustrating the utilization of a conveyor speed input to determine belt utilization in terms of accumulated lineal feet; and FIG. 6 is a view similar to FIG. 4 and illustrating a display panel comprising an array of readouts responsive to workpiece sensors operatively coupled to data processing means, the panel visually indicating the target duration setting for cumulative workpiece sensing per shift along with an indication of the accumulated and actual duration of time of exposure to workpiece surfacing operations.

DESCRIPTION OF THE PREFERRED EMBODIMENT

Figure 1:
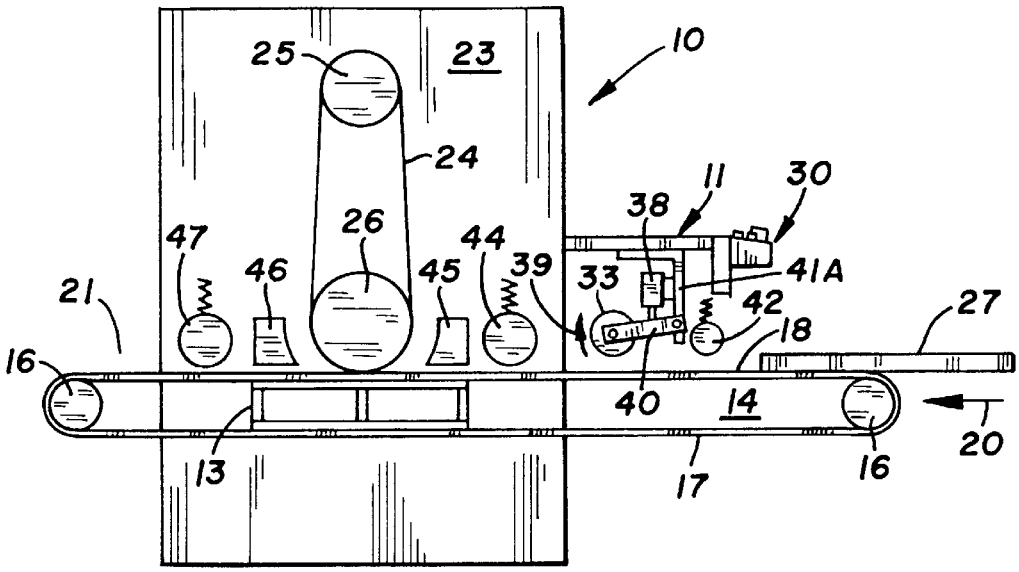
FIG. 1 is a front elevational view of a wide-belt abrasive surface treating apparatus operating in combination with the belt utilization prompter/monitor system of the present invention.
Figure 2:
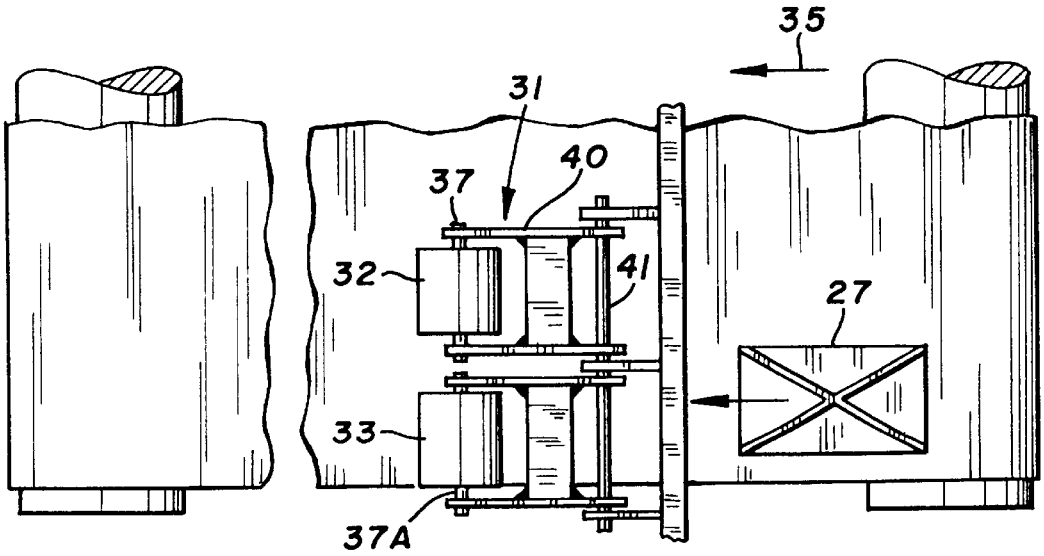
FIG. 2 is a fragmentary top plan view of certain components illustrated in FIG. 1 and showing the detail of a portion only of the array of preferred workpiece sensors, with FIG. 2 being shown on an enlarged scale.

In accordance with the preferred embodiment of the present invention and with particular attention being directed to FIGS. 1 and 2 of the drawings, a wide-belt abrasive surface treating apparatus generally designated 10 is illustrated in combination with the width utilization prompter/monitor system of the present invention as shown generally at 11. The surface treating apparatus is a wide belt sander including a frame, a portion of which is illustrated at 13, supporting a conveyor shown generally at 14. Conveyor 14 includes a drive means with drums 16-16, is supported on frame 13 and carriers and supports a moving endless belt 17 therealong. Belt 17 includes a top flight as at 18 for transporting workpieces between the infeed end 20 and discharge end 21. A workpiece treating station shown generally at 23 is operatively positioned between infeed end 20 and discharge end 21, with workpiece treating station 23 comprising a wide-belt sander assembly driving abrasive belt 24 in an orbital path between drums 25 and 26. Drum 26 positions belt 24 immediately adjacent top flight 18 for contacting and surface abrading workpieces as they are being transported along top flight 18. One typical workpiece 27 is illustrated entering the infeed end 20 while positioned on the surface of top flight 18.

Figure 3:
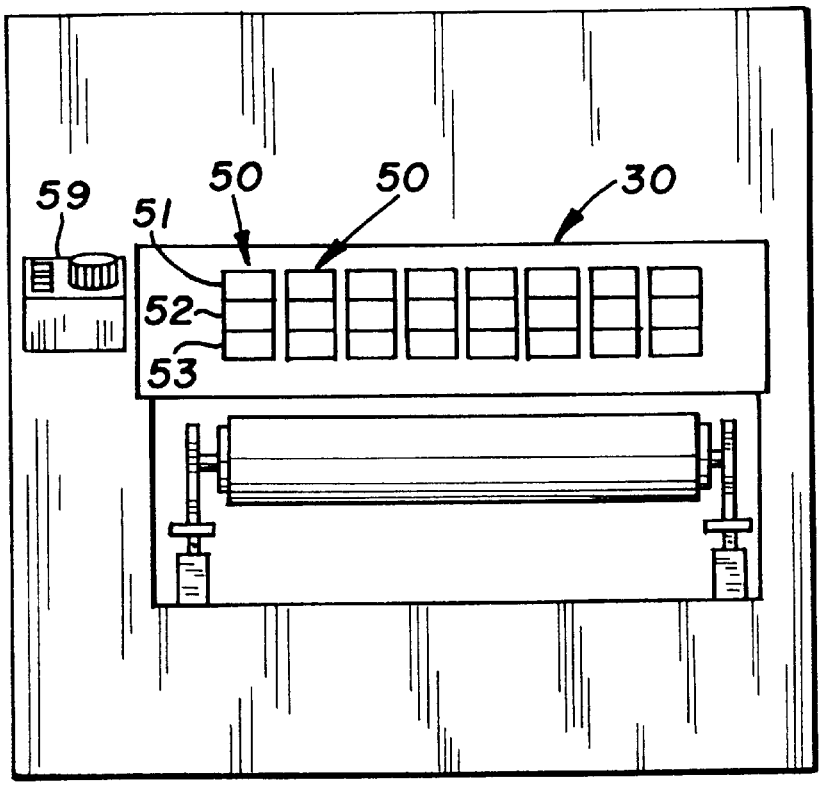
FIG. 3 is an end elevational view taken of the infeed end of the system illustrated in FIG. 1 and further illustrating an information display panel.

With attention being further directed to FIGS. 1 through 3 of the drawings, the abrasive belt width utilization prompter/monitor system 11 is operatively coupled to abrasive surface treating apparatus 10. In addition to workpiece sensors described hereinafter, system 11 includes a readout means shown generally at 30, with readout 30 being operatively coupled to an array of workpiece sensors shown generally at 31. Array 31 comprises a plurality of individual axially spaced apart signal generating workpiece sensors such as those shown at 32 and 33. Sensors such as 32 and 33 are disposed in axially spaced apart relationship across the entire width of the belt and transverse to drive axis 35 of belt 18. Each sensor such as 32 and 33 comprises a contact drum and each is mounted for rotation about an axle shaft with the axle shaft for sensor 32 being shown at 37, and that axle shaft for sensor 33 being shown at 37A. In order for the drums to move in response to contacting a workpiece and to achieve arcuate motion as indicated at 39, sensor drum mounting arms or brackets 40-40 are pivotally coupled to support shaft 41. Support shaft 41 is mounted on frame member 41A, as illustrated in FIGS. 1 and 2. Accordingly, sensors 32 and 33 are each coupled to individual switches such as at 38, with switches 38 having contacts which are actuated (opened or closed) in response to arcuate pivotal motion of a contact drum such as drum 33 as shown at arcuate arrow 39.

In actual operation, workpiece 27 is placed upon the surface of top flight 18, and moved into contact with pinch roll 42. Roll 42, in turn, moves workpiece 27 along top flight 18, and into contact with the one or more of contact drums forming array 31. Upon contacting one or more of drums in the array such as drums 32 and 33, the drum will rock or tip upwardly and remain elevated during the duration of time that workpiece 27 is positioned beneath the contact drums such as drums 32 and 33. Thereafter, workpiece 27 reaches pinch roll 44, passes beneath shoe 45 and into contact with abrasive belt 24 as belt 24 is driven in its orbital path determined by drums 25 and 26. Thereafter, and while remaining in contact with belt 24, workpiece 27 is held in proper disposition beneath shoe 46, and thereafter passes under pinch roll 47 and outwardly at discharge end 21.

With attention now being directed to FIGS. 3 and 4, readout means comprising information panel 30 which in turn includes a plurality of indicator lamps is operatively coupled to a processor means. In this operation, the processor is responsive to sensor input signals, with the processor accumulating the duration of workpiece contact times representative of signals from the individual switches 38-38. Each readout means includes an independent column of lamp indicators as at 50-50. Each lamp column includes a group of individual lighted or illuminated zones or lens as at 51, 52, and 53. For purposes of this illustration, each of the illuminated zones 51, 52 and 53 will be provided with colored lenses, for example, a green lens in lamp or zone 51, amber lens in zone 52, and a red lens in 53. Signal processing systems suited for this application and responsive to on-off durations of switches as at 38-38 are known and commercially available. The processor in the data processing means functions to determine the accumulative duration of time during which the presence of a workpiece has been detected by each individual sensor drum, such as drums 32 and 33. The accumulative duration is, in this instance, the total or aggregate period of time during which workpiece 27 is present beneath individual sensor drums. The accumulated duration of time represents the exposure of wide belt 24 to the surface of workpieces. The processor is also capable of determining that certain sensor which has detected the least (as well as the greatest) duration range of exposure time for all of the sensors. For most purposes, the duration range selected will be that representing the least cumulative duration of time during which a workpiece has been detected. The processor has a comparator function so as to compare the duration of cumulative workpiece exposure times of the individual segments relative to that of the least utilized segment. This comparison identifies the least utilized as constituting the given datum time base or reference. The datum time reference is, as indicated above, that certain sensor detecting the shortest duration of workpiece presence. The comparator is further provided with a function responsive to and capable of identifying time interval differentials, such as illustrated diagrammatically in FIG. 5. When a certain predetermined first time interval differential reaches but does not exceed a predetermined time tolerance of differential is illustrated at "A", processor 55 will deliver a signal along line 56 to continue to illuminate lamp or zone 51. In a typical installation, lamp 51, glowing green, will remain on at all periods during which the time interval differential "A" does not exceed interval represented by lines indicated "A". When interval "A" is exceeded, interval "B" becomes active, and this occurrence causes a signal to be delivered along line 57 to illuminate amber lamp 52. Upon reaching this stage, lamp 51 is preferably extinguished, leaving lamp 52 illuminated solely. So long as time interval differential does not exceed that represented by arrow "B", lamp 52 remains illuminated. Upon exceeding interval "B", time interval "C" becomes active. When interval "C" is active, processor 55 delivers power to line 58, thereby illuminating red lamp 53. Upon illumination of lamp 53, lamps 51 and 52 are extinguished. In the example provided in connection with FIGS. 3, 4 and 5, it is presumed that there are eight sensors present in the array, with each being positioned to detect workpieces along its aliquot segment or portion of the transverse width of the belt. Depending upon the width of the belt and the machine applications, a reasonable number of sensors may be provided in order to form the array. For most wide-belt applications of up to, for example, 48 inches, a total of eight sensors will generally be found adequate.

In order to achieve the desired function of uniform utilization of individual segments of the wide belt, the machine operator is prompted upon observing lamps 52 and/or 53 becoming illuminated. In order to correct the use imbalance and re-establish uniformity, the operator is trained to reduce or cease utilization of the areas represented by the amber or red illumination, while endeavoring to position more workpieces into those areas represented by green illumination. Skilled operators may undertake the corrective action expeditiously, without interfering with overall production rates of the abrasive machine, while at the same time operating to improve belt width utilization and machine life. In addition to improving width utilization, product uniformity is also enhanced.

Time Interval Differential Considerations

In a typical application, time interval differentials of up to about one hour are readily anticipated, and hence so long as the differential does not exceed one hour, the green lamp will remain illuminated. By way of further example, when a period of one hour is exceeded, and a period of, for example, two hours has not been exceeded, the amber lamp will be illuminated. Upon the occurrence of a time interval differential existing which is greater than two hours, the red lamp will become illuminated. Supervisory personnel may monitor operator efficiency by observing the frequency of red lamp illumination.

Cumulative Time

As an added feature of the present invention, processor 55 is provided with a functional capability of indicating the absolute magnitudes of cumulative time for activation of each of the sensors. In this fashion, the replacement time for individual abrasive belts such as belt 24 can be accurately predicted, inasmuch as the life expectancy for such belts is readily determined by individual operators and supervisory personnel for abrasive machines.

With attention being directed to FIG. 6, the belt utilization indicator means shown generally at 60 includes a display panel with a number of rows and columns comprising an array such as columns I–VI inclusive, with each column consisting of a pair of individual information readouts. In this connection, the target setting time per shift may be displayed in the row such as at 61, with the accumulated total of actual time being shown in the row such as at 62. Digital readouts are conveniently employed for this purpose, and are, of course, commercially available. When this feature is employed, supervisory personnel will be able to determine the efficiency and performance of a machine and its operator by determining if the target setting goal per shift is reached, with the accumulated total time being utilized to anticipate belt replacement time. This is readily accomplished by comparing accumulated actual time with expected belt life.

As an alternate method of measuring belt life, the total lineal feet of workpiece exposure may be determined by the apparatus of the present invention. In order to calculate the total number of lineal feet of workpiece exposure, the conveyor speed may be utilized as an input to the processor, with conveyor speed in combination with time of workpiece exposure being utilized to determine lineal feet of work processed. The conveyor speed input is indicated in FIG. 5 at 70.

Reset Mechanism

In order to coordinate the operation of a machine between different operators, for example, operators of different shifts, or at other relevant intervals, reset mechanism 59 is provided. When the information being displayed is no longer needed, it may be deleted. Information may be retained so long as it may be reasonably convenient, necessary, or required.

Machine Output Determined

In the system illustrated in FIG. 6, a timer is linked to the conveyor drive speed in order to convert workpiece detected time to lineal feet of product output. Product output, in turn, is expeditiously represented by the accumulated actual lineal feet of production illustrated by individual readouts 62.

In multiple-head machines, a system such as illustrated at 60 may be provided for each individual sanding head. In a typical installation, multiple sanding heads will typically employ different grits in order to achieve desired performance and results in the equipment. Since belts carrying coarse grits tend to have longer anticipate lifetimes than those with fine grits, belt replacement may be scheduled on an as-required basis for each of the individual operating heads. Such operations not only is economically sound, but also reduces any adverse impact on the environment.

Alternate Sensors

In the present embodiment, mechanically actuated or driven sensors are employed, and it will be appreciated that alternative forms of sensors may also be utilized. In this connection, proximity sensors utilizing radiant energy (light) may be employed with individual cooperating pairs of light sources and light detectors being positioned in an array extending transversely of the width of the conveyor belt 17.

As a still further alternative, a source of sonic energy may be employed to detect and indicate the presence of a workpiece along a lateral segment of the belt, with a sonic generator and receiver being positioned in proximity to the belt for the purpose of detecting the presence of workpieces at various laterally disposed positions along belt 17.

It will be appreciated that the examples and apparatus given herein are provided for illustration purposes only, and are not to be construed as a limitation upon the scope to which the present invention is reasonably entitled.

What is claimed is:

1. In a wide belt abrasive surface treating apparatus having a frame supporting a conveyor with drive means and an endless belt with a drive axis and a top flight for transporting workpieces along said top flight from an infeed end to a discharge end with at least one workpiece treating station operationally positioned between said ends and having a wide abrasive belt operatively superimposed adjacent said top flight for contacting and surface abrading workpieces being transported thereon; the improvement comprising:

(a) an abrasive belt use monitor system operatively coupled to said wide belt abrasive surface treating apparatus, said belt use monitor system comprising an array of individual axially spaced apart signal generating workpiece sensors operatively positioned across the width of said belt and transverse to said drive axis, with each sensor creating a signal in response to the presence of a workpiece moving along a certain predetermined corresponding segment of said conveyor belt;

(b) readout means for receiving signals from each of said sensors, with each readout means including a readout indicator responsive to a selected one of said sensors;

(c) data processing means coupled to said readout means and said sensors, said data processing means being adapted to:

(1) determine the accumulative duration of time that each sensor operably detects the presence of a workpiece at said corresponding segment of said conveyor belt;

(2) compare the respective accumulative times among each of said sensors to define a cumulative time range limit; and (3) generate and deliver signals to said readout means for operable indication thereat of accumulated time differentials of respective said sensors with respect to such range limit.

2. The wide belt abrasive surface treating apparatus of claim 1 wherein said duration range limit of time is represented by that certain sensor which has detected the least duration of time.

3. The wide belt abrasive surface treating apparatus of claim 1 wherein said readout means comprises a panel with means for visually indicating such time differentials.

4. The wide belt abrasive surface treating apparatus of claim 3 wherein said visual means comprises a plurality of lighted indicia for indicating such time differentials.

5. The wide belt abrasive surface treating apparatus of claim 1 wherein each sensor in said array of sensors comprises a mechanical sensor for contacting the surface of individual workpieces moving along said top flight.

6. The wide belt abrasive surface treating apparatus of claim 1 wherein said sensors comprise a proximity sensor utilizing radiant energy.

7. The wide belt abrasive surface treating apparatus of claim 1 wherein said sensors comprise a proximity sensor utilizing sonic energy.

8. The wide belt abrasive surface treating apparatus of claim 1 wherein said readout means includes means for indicating the absolute magnitudes of cumulative time for each of said sensors.

9. The wide belt abrasive surface treating apparatus of claim 8 wherein said data processing means includes a conveyor rate of speed input determining the aggregate length of the workpieces transported along said top flight and detected by said sensors over an interval of time.

* * * * *